US005884511A

United States Patent [19]

Preddey

[11] Patent Number: 5,884,511

[45] Date of Patent: Mar. 23, 1999

[54] MECHANICAL CARD LOCK

[75] Inventor: Brian Francis Preddey, Gerrigong, Australia

[73] Assignee: Cardlok Pty. Ltd., Gerrigong, Australia

[21] Appl. No.: 668,936

[22] Filed: Jun. 24, 1996

Related U.S. Application Data

[63] Continuation of Ser. No. 211,714, filed as PCT/AU92/00577, Oct. 6, 1992, abandoned.

[30] Foreign Application Priority Data

Oct. 24, 1991 [AU] Australia ..... PK 9097
Apr. 3, 1992 [AU] Australia ..... PL 1714

[51] Int. Cl.[6] ..... E05B 21/00

[52] U.S. Cl. ..... 70/350; 70/352; 70/341

[58] Field of Search ..... 70/352–355, 387, 70/383–385, 340–343, 350, 351

[56] References Cited

U.S. PATENT DOCUMENTS

| | | | |
|---|---|---|---|
| 14,896 | 3/1856 | Lippincott . | |
| 2,692,495 | 10/1954 | Verdan . | |
| 3,271,983 | 9/1966 | Schlage . | |
| 3,555,858 | 1/1971 | Owen | 70/352 |
| 4,114,410 | 9/1978 | Astier | 70/339 |
| 4,149,394 | 4/1979 | Sornes | 70/352 |
| 4,587,815 | 5/1986 | Gil | 70/352 |
| 4,627,252 | 12/1986 | Lo | 70/351 |
| 4,691,545 | 9/1987 | Pagano | 70/352 |
| 4,932,228 | 6/1990 | Eisermann | 70/276 |
| 5,343,724 | 9/1994 | Sornes | 70/340 |

*Primary Examiner*—Steven Meyers
*Assistant Examiner*—Gary Estremsky
*Attorney, Agent, or Firm*—Banner & Witcoff, Ltd.

[57] ABSTRACT

A mechanical card lock is disclosed which allows for simple, reliable operation. User cards 221 are engaged by a set of plates 360, which upon operating the lock assume a configuration for mating with a previously inserted combination card 244. The lock can be rekeyed by replacing the combination card 244.

28 Claims, 15 Drawing Sheets

Fig 7a.
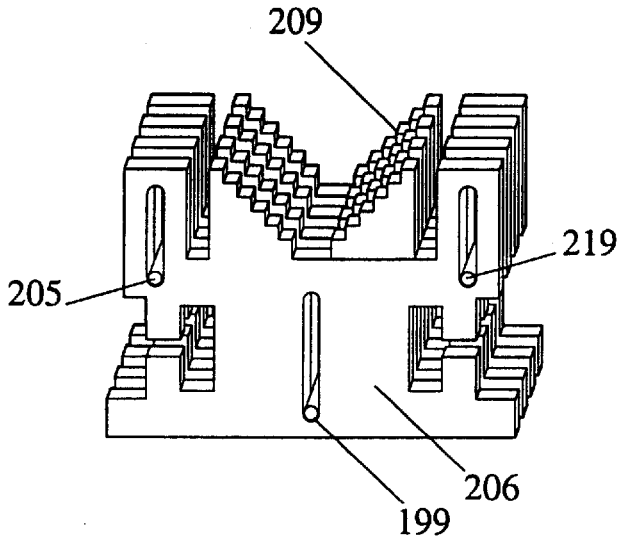
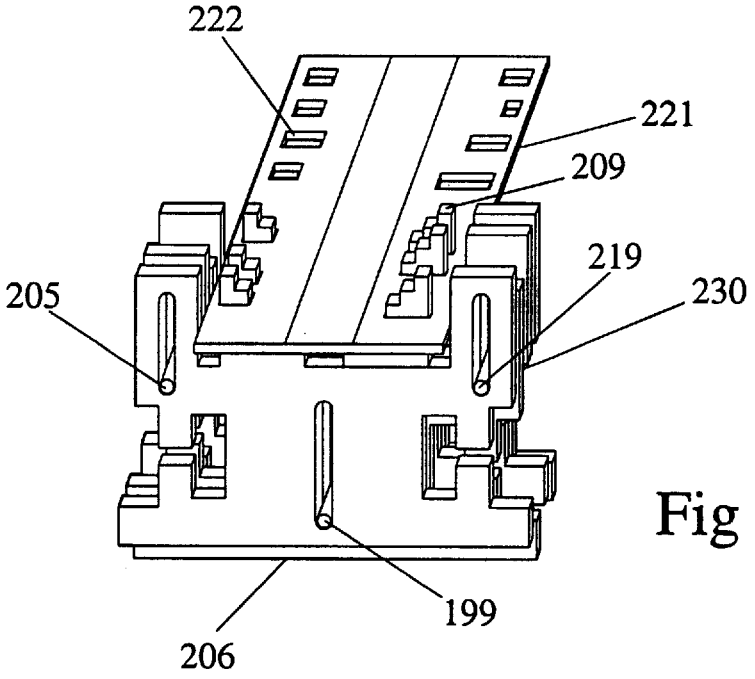
Fig 7b.

MECHANICAL CARD LOCK

This application is a continuation of Ser. No. 08/211,714 filed Apr. 22, 1994, now abandoned, which is a 371 of PCT/AU 92/00577, filed Oct. 6, 1992.

TECHNICAL FIELD

This invention relates to a mechanical lock system using cards.

BACKGROUND ART

Increasingly, electronic card systems using magnetic or otherwise coded cards and slide type readers have been used to replace mechanical locks. These are relatively expensive, both in capital costs and in frequency of maintenance.

One problem associated with key operated locks is the difficulty of re-keying the lock. If a key is lost or stolen, a locksmith is required to provide a set of new keys and alter all the common-keyed locks. Mechanical card locking systems are known from e.g. U.S. Pat. No. 4,149,394 (Sornes), which utilise a card having round holes therein. The card can be inserted into the lock, whereby biased ball bearings are displaced. It the ball bearings are displaced in a predetermined manner, the lock can be opened. A similar ring-operated lock is disclosed in U.S. Pat. No. 4,338,805 to Nygren. These arrangements all subject the card to considerable wear, and allow for operation from one side only. Further, they cannot be readily re-keyed, nor do they allow for the use of a magnetic strip in addition to the mechanical mechanism. Such arrangements only allow for one possible position for each ball or ring, and do not allow for master keying hierarchies.

U.S. Pat. No. 4,627,252 (Lo) discloses a card operated lock using a set of plates arranged to directly receive a card with notches selectively removed in the end. This lock is only operable from one side, and re-keying involves rearranging the plates. The user card directly engages the lock mechanism. This arrangement only allows for one possible position for each ball or ring, and does not allow for master keying hierarchies.

French Patent Specification No. 1,163,526 (Beaudelet) discloses a simple mechanical lock arrangement comprising a series of spring loaded locking tumblers which are capable of being displaced independently of one another in a plane perpendicular to that in which the slide bolt is displaced. The mechanism is operable by use of a key featuring a series of grooves of varying depths, witn one groove provided for each tumbler. Upon insertion of the key the tumblers undergo varying displacements, with the correct combination of displacements leading to the unlocking of the mechanism. However this mechanical lock arrangement does not allow for the re-keying of the lock mechanism.

U.S. Pat. No. 2,692,495 (Verdan) discloses a complex mechanical lock arrangement operable using a user card including a pattern of holes and a combination card to define a combination for the lock mechanism. Unlocking of the mechanism is achieved the pattern of holes in the user card matches those on the counter key. However whilst this arrangement does enable the rekeylng of the lock mechanism, it is a complex arrangement which would be difficult to manufacture and which would require frequent maintenance in order to provide satisfactory and consistent working performance.

It is therefore an object of the present invention to provide a mechanical card lock which overcomes at least partly, the disadvantages of the prior art.

DISCLOSURE OF INVENTION

According to one aspect the present invention provides a lock mechanism operable using a user card including a pattern of slots extending therethrough and a corresponding combination card, the lock mechanism comprising a plurality of generally parallel plates arranged such that the plates are operatively enabled to slide relative to each other in a direction substantially perpendicular to the plane of the user card, at least some of the parallel plates operatively engaging the combination card with an edge of the plates so as to define a combination for the lock mechanism, at least some of the parallel plates including projections adapted to be operatively inserted to a plurality of depths through the slots in the user card; means for operating the lock mechanism; means for enabling release of the lock mechanism;

the arrangement being such that after the user card is inserted into the mechanism, the means for operating the lock mechanism may be operated to cause the plates to slide in a direction substantially perpendicular to the user card so that the projections pass through the slots to a plurality of depths, the meane for operating further engaging the plates and the combination card on a different edge of the plates, such that the lock mechanism is released only if the user card enables the plates to be moved to define a corresponding pattern to that defined by the combination card, thereby releasing the lock mechanism.

According to a further aspect the present invention provides a user card adapted to be used with a lock mechanism comprising a plurality of generally parallel plates arranged such that the plates are operatively enabled to slide relative to each other in a direction substantially perpendicular to the plane of the user card, at least some of the parallel plates operatively engaging a combination card with an edge of the plates so as to define a combination for the lock mechanism, at least some of the parallel plates including projections adapted to be operatively inserted to a plurality of depths through the slots in the user card;

wherein the card has a plurality of substantially rectangular slots positioned intermediate the card and extending through the plane of the card, the long axis of the slots being generally perpendicular to the direction of insertion of the card, such that the depth of insertion of each of the projections is dependent on the size of the openings, and the depth of insertion and hence extent of movement by the plates provides the combination for opening the lock.

BRIEF DESCRIPTION OF DRAWINGS

The invention will now be described in more detail with reference to the drawings, in which:

FIG. 7 is a perspective view of the plate components according to the second embodiment;

DETAILED DESCRIPTION

First Embodiment

Figure 1:
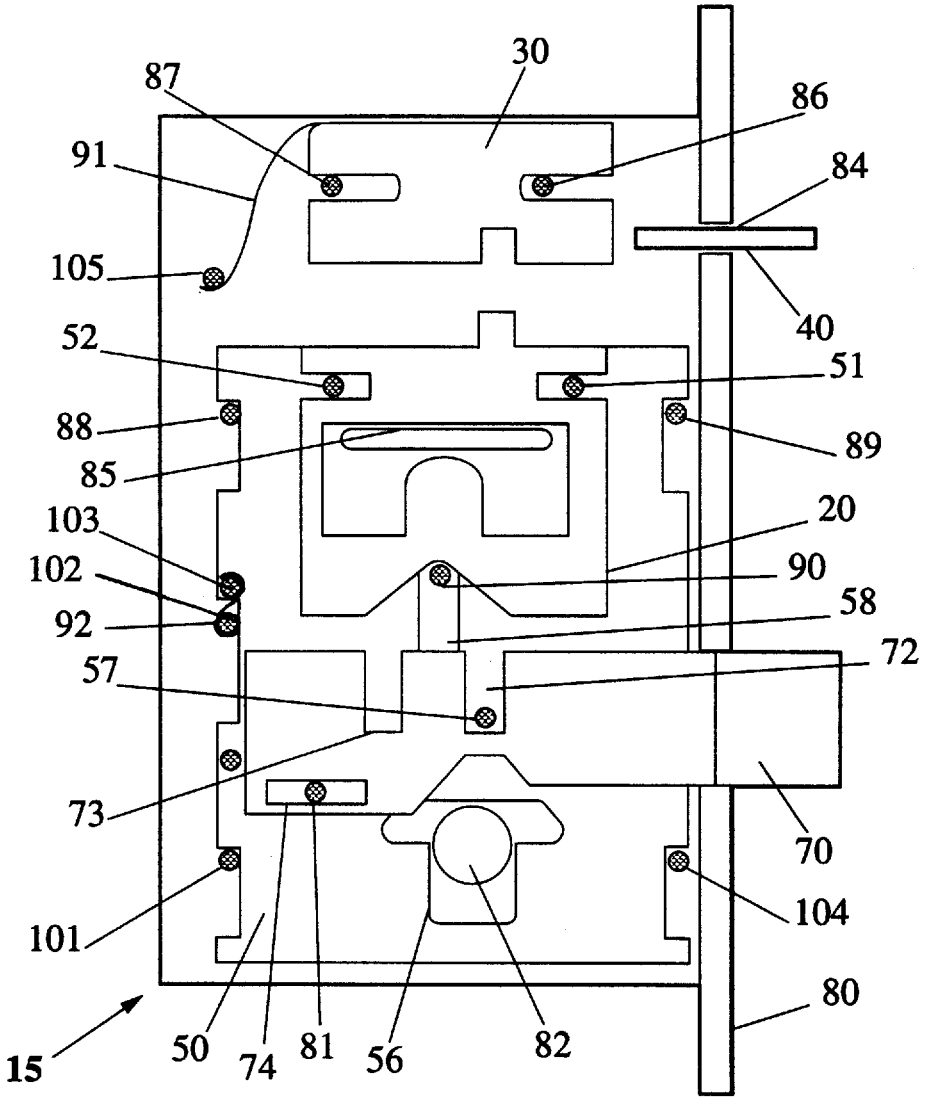
FIG. 1 illustrates a simplified schematic view of an assembled lock according to a first embodiment in a cutaway view.

Referring to FIG. 1, the lock mechanism 15 is based on body 80. The body 80 includes a number of pins and recesses, whose functions will be described in more detail below, and provides the externally visible surfaces of the lock.

Body 80 supports plate 50 via pins 88, 89, 101–104 and respective recesses 55, 54, 115, 114 and 116. It can be seen that plate 50 in the assembled position is enabled to slide vertically relative to body 80. Spring 92 retains the plate 50 in position via pins 102, 103.

Body 80 also supports lock plate assembly 30, via pins 86, 87 and recesses 33, 34. As will be seen from FIG. 2, lock plate assembly 30 comprises a series of similar plates 31 stacked in a laminar fashion and enabled to slide horizontally—note the movement available between pins 86, 87 and recesses 33, 34.

Body 80 also includes recess 84 for insertion of combination card 40. Combination card 40 includes a shaped pattern of recesses and protrusions 41 (see FIG. 2) with widths matching the thickness of plates 31 so that the plates 31 are pushed horizontally into a pattern defined by combination card 40. Spring 91 retained by pin 105 maintains the plates in position when no combination key 40 is in place.

Plate 50 supports, via pins 51 and 52, and recesses 23, 24, key plate assembly 20. Pin 90 also extend from body 80 through slot 58 to support and align the plate assembly 20. The key plate assembly 20 comprises a set of plates arranged similarly to lock plate assembly 30, and of the same thickness but of a different cross-sectional shape.

Bolt 70 rests on plate 50 and is secured in the locked or open position by pin 57. Spring 92 retains the bolt 70 in position. Bolt 70 passes through recess 83 in body 80. Bolt 70 includes recesses 72, 73 in its upper surface which define the open and locked positions respectively. Pin 81 and slot 74 provide support and guidance for bolt 70. Opening 53 allows for movement once user card 10 is inserted in slot 85.

Figure 2:
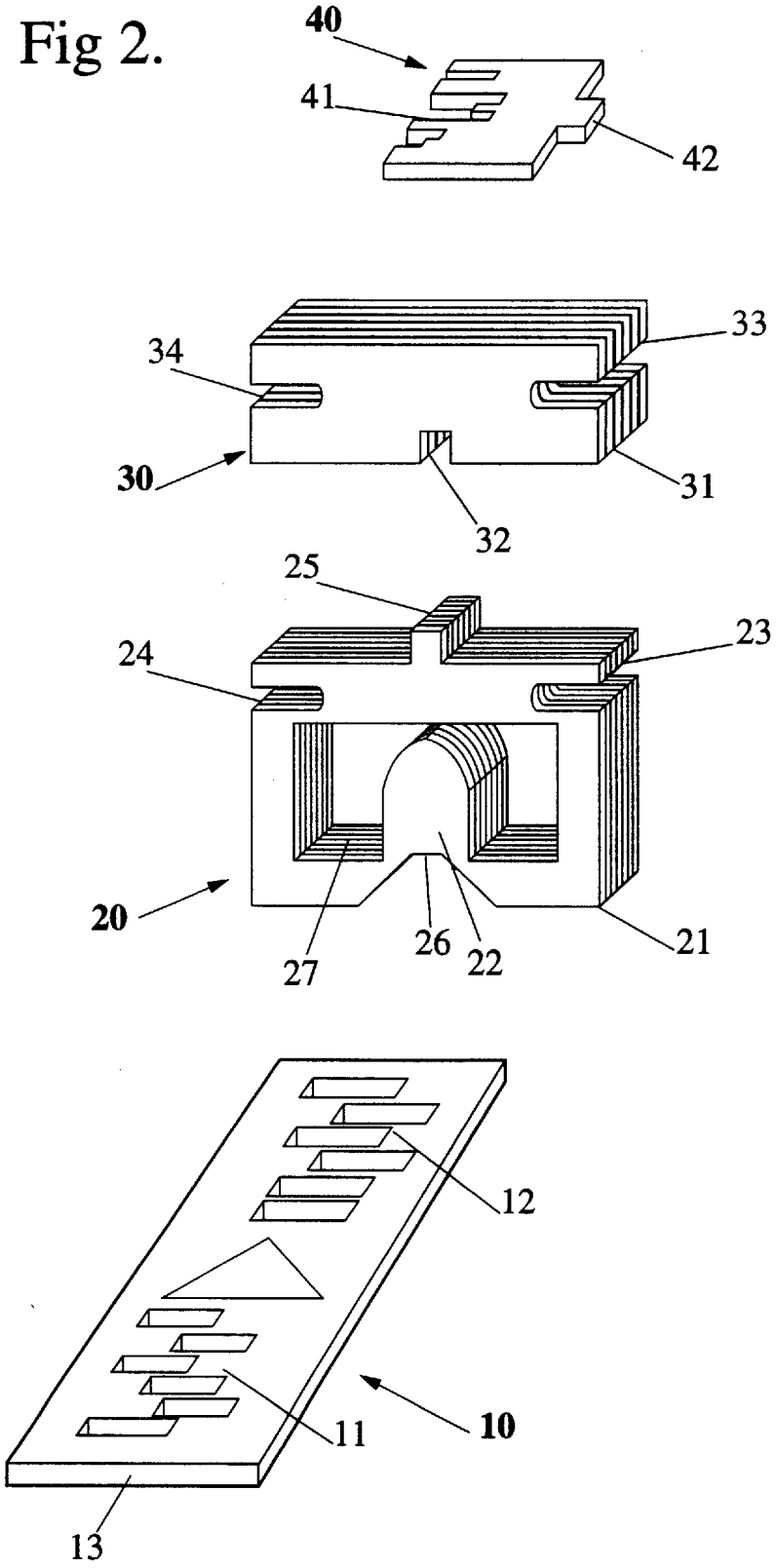
FIG. 2 illustrates in perspective the card and lock components of the first embodiment.

Referring to FIG. 2, user card 10 includes various slots 11, the distance from the end 13 of each of which is predetermined. while the sideways displacement defines a particular key combination from the variety available. Preferably, the slot combinations 11, 12 at each end are mirror images to facilitate locking and unlocking from either side of the door.

The operation of the interlocking mechanism will now be described with reference to FIG. 2.

User card 10 is inserted into the cavity 27 of key plate assembly 20. The plates 21 and thus lugs 22 are upward relative to user card 10, the lugs 22 pass through the recesses 11 in user card 10, causing plates 21 to re-align horizontally. The mechanism for relative movement will be described below.

The thereby re-aligned plates 21 accordingly define a specific pattern in the protruding tabs 25 which extend upwardly from the plates.

Referring to the lock plate assembly 30, the combination key 40 when inserted displaces the plates 31 so as to create a specific pattern of recesses 32 in the base of the lock plate assembly 30.

If the pattern of recesses 32 and tabs 25 match, the tabs are received in the recesses and tho lock released (as will be described below).

It will therefore be appreciated that for each combination card 40 there is a corresponding pattern of plates formed, and hence a corresponding pattern of slots 11 in user card 10.

The exact number of recesses, and hence plates, may be varied as desired with corresponding alternatives to the number of key plates 21 and lock plates 31.

Figure 3:
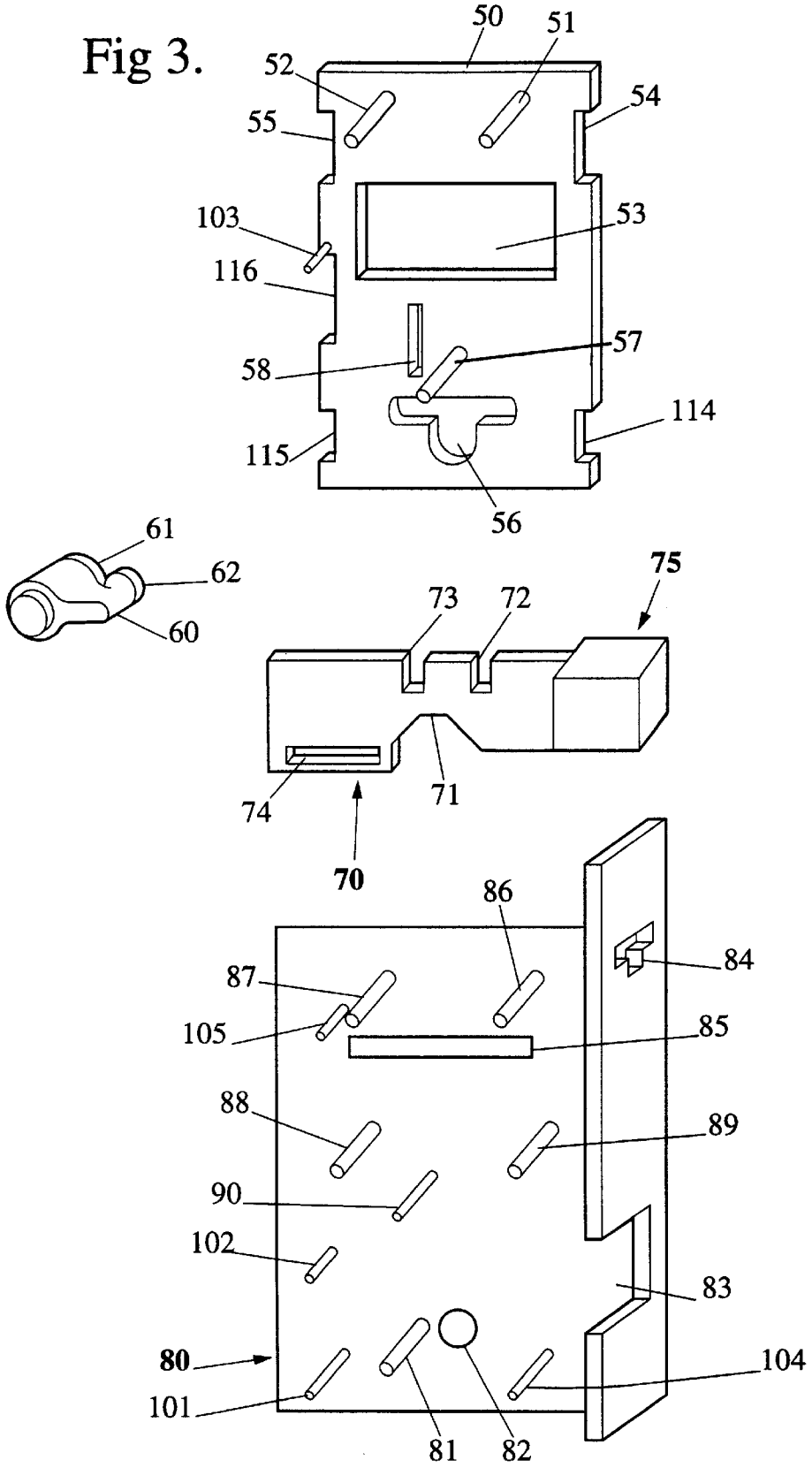
FIG. 3 is a perspective view of the body and plate components of the first embodiment.

FIG. 3 shows in detail the other lock components. Referring also to FIG. 2, the operation of the lock will be described.

Cam means 60 is received in recesses 56 and 82 (not shown) via seat 61. As cam means 60 is rotated clockwise, it raises plate 50 via cam 62 and hence key plate assembly 20 towards lock plate assembly 30. It also lifts pin 57 in slot 72. As the key plate assembly 20 is moved up, the lugs 22 are pushed into slots 12 of the user card 10 and hence are shifted horizontally in a pattern corresponding to the key. As cam means 60 is rotated towards the top position, tabs 25 and recesses 32 approach each other. If they match, and tabs 25 are received in recesses 32, then pin 57 is lifted clear of slot 72, the cam acts on recess 71, and the bolt 70 moves to the locked position. On further rotation, pin 57 enters slot 73 and so retains bolt 70 in the locked or unlocked position.

Preferably, spring means (not shown) ensures that key plates 21 return to the aligned position as they are lowered, so as to not retain a record of the correct alignment of the plates for opening.

It will be appreciated that if one key is lost or otherwise "re-keying" of the lock is required, all that is needed is a new combination card 40 and a set of new user cards 10. This system may be used to enhance security in hotels, by providing each guest with a randomly selected key and combination cards.

Figure 4:
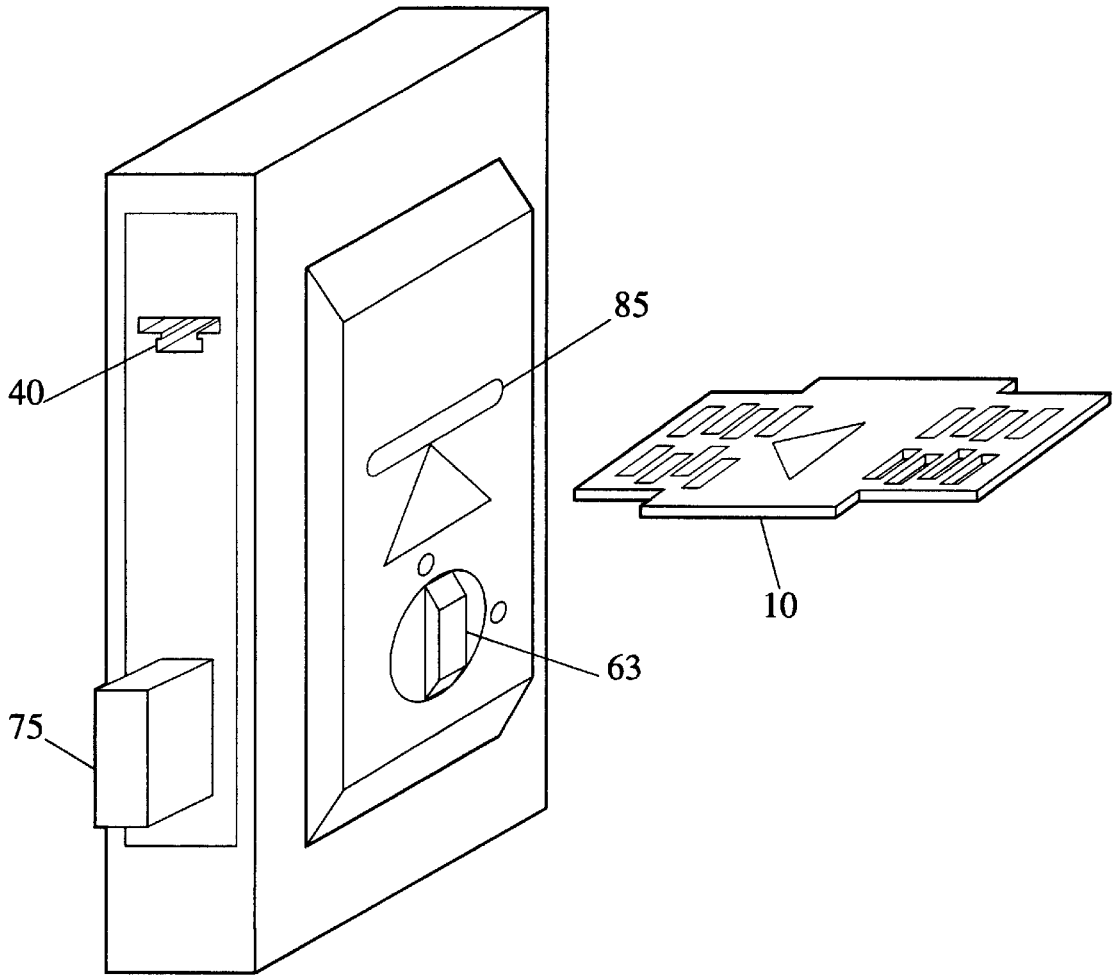
FIG. 4 shows in perspective one form of the assembled lock.

An example of a possible external configuration is shown in FIG. 4. Combination card 40 has already been placed in opening 84. User card 10 is inserted into slot 85, and knob 63 rotated. If the correct key is inserted, It will rotate from locked to unlocked or vice-versa: otherwise, it will only rotate part-way and will not move bolt 75.

Second Embodiment

Illustrated in FIGS. 5 to 8 is an embodiment of the present invention which utilises a set plate configuration, wherein the combination can only be changed by replacing one or more plates. This embodiment uses a preferred stepped plate arrangement for engaging the card.

Figure 5:
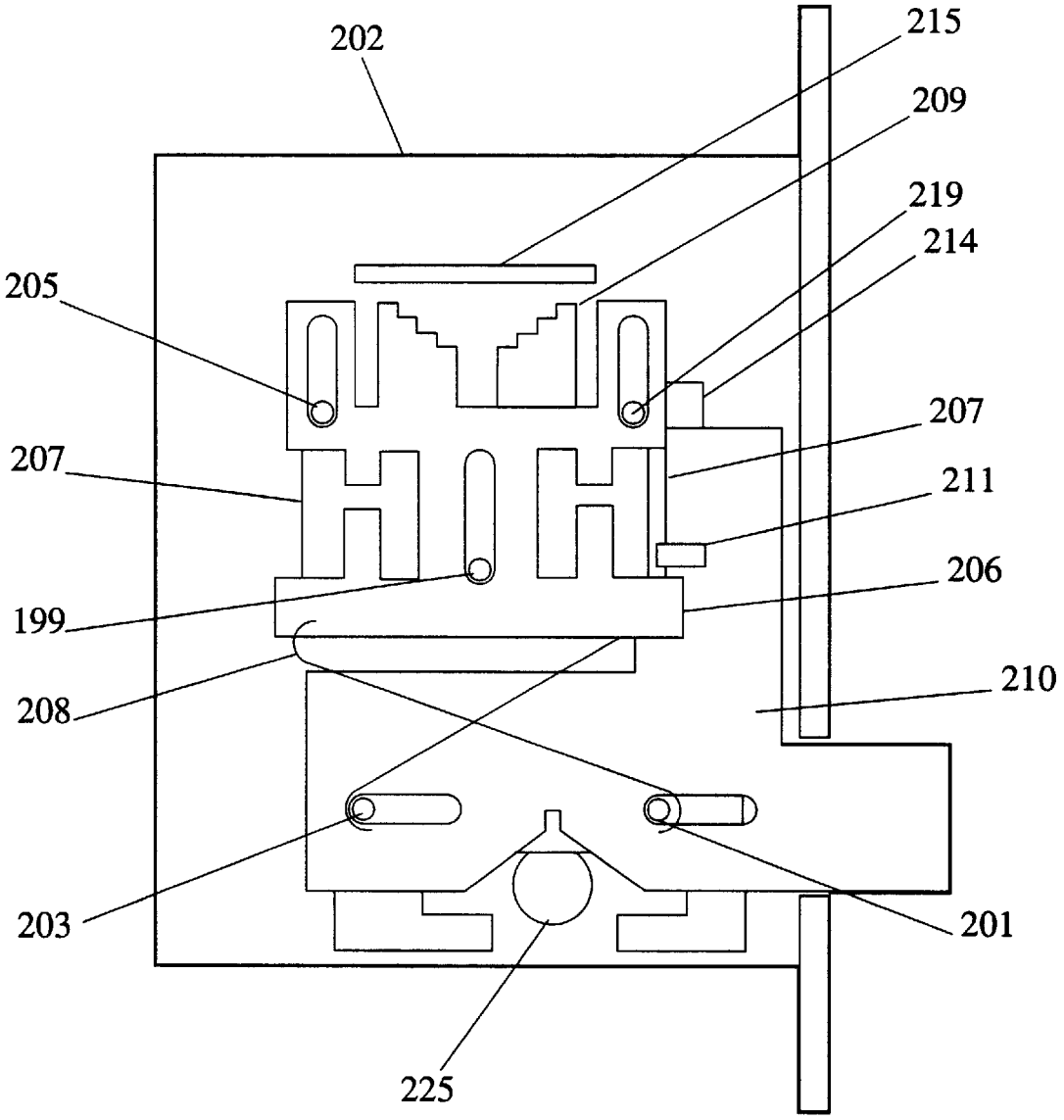
FIG. 5 shows a simplified schematic view of a second embodiment.
Figure 8:
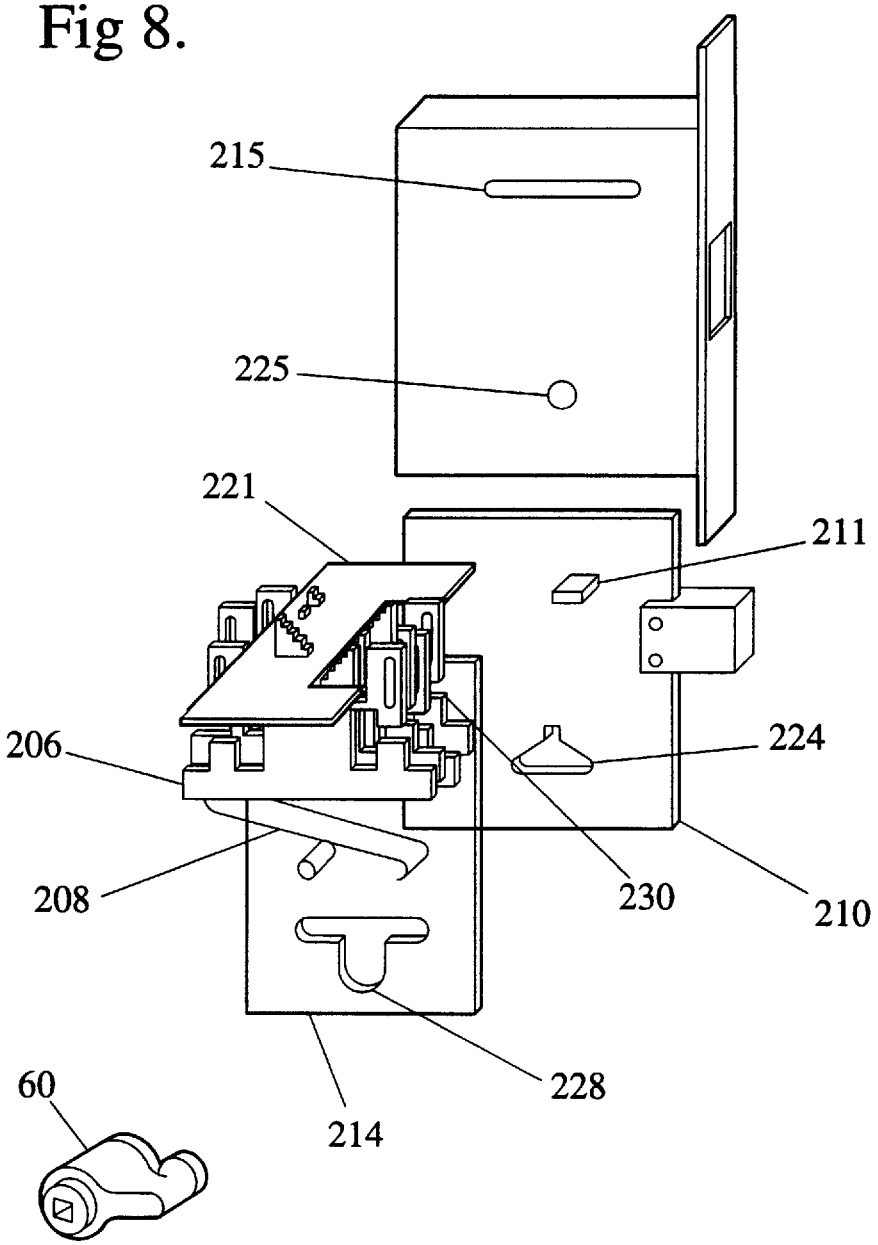
FIG. 8 illustrates partly in perspective an exploded view illustrating the operation of the second embodiment.

The lock according to this embodiment comprises a lock body 202 having pins 201, 203 located thereon. A lever slide plate 214 which slides up and down and is located by pins 201,203. (Slide plate 214 is also visible in FIG. 8.) The lever slide plate 214 has attached to it, by means of pins 199, 205, 219, a series of card engaging means in the form of slide plates 206. As illustrated in FIG. 7 and FIG. 8, the slide plates 206 are located in staggered formation as this allows a greater distance between the holes 222 on card 221, illustrated in FIG. 6. Slide plates 206 have a stepped portion 209 on an upper portion thereof, whilst at a middle or lower portion there are lock gates 207, one on either end of slide plates 206. Having a gate 207 on each end allows the slide plates 206 to be reversible, and so they can be arranged in alternate arrangement as illustrated in FIG. 7 with steps portions 209 on the left and right hand side. The slide plates 206 are mounted on pins 199, 205, 219 which are attached to plate 4, and as illustrated in FIG. 5 a spring 208 biases slide plates 206 relative to pins 201,203 on lever slide plate 214.

The locking mechanism also includes a bolt plate 210 having a gate post or pin 211. The bolt plate 210 is locked either in the open or in the closed position when the gates 207 are not aligned. The body of the lock mechanism includes a slot 215 for the insertion of card 221 (illustrated in FIG. 6). Also pivoted to the body 202 is a cam shaft 60 which (as in the first embodiment) has a dual purpose of pushing the slide plates in an upward direction and once the gates 207 are aligned, so as to open channel 230, moving the bolt plate 210 and hence bolt 211 to the locked or unlocked position. These actions are performed in this arrangement when the card 221 having the correct combination is inserted in the slot 215. The cam shaft 60 is of a shape to engage recesses 228, 224 in the plates 214 and 210, through recess 225 in lock body 202.

Operation of the locking device is as follows. A card 221 is inserted in slot 215. The card is of a reversible nature and the lock can be opened from either side. Once in position, the card has holes 222, preferably of a square or rectangular nature, which when correctly positioned allow the stepped portion 209 of each slide plate 206 to move in an upward direction until such time as a step of stepped portion 209 cannot pass through the hole 222 in card 221. The length of the slot or hole 222 in the card 221 determines the length of travel in the vertical direction which the slide plate 206 will move. When the slide plate 206 is prevented from moving any further through card hole 222 the slide plate 214 continues in an upward direction compressing respective springs 208 of those slide plates 206 which can move no further. Slide plates 206 that can move will continue to do so until such time as a corresponding step engages the side of the hole 222 on card 221. When all the step portions 209 of slide plate 206 are in the correct position, gates 207 on adjacent slide plates 206 are in an aligned orientation so as to form channel 230, allowing the gate post 211 on bolt plate 210 to move into the gate 207. A single turn of shaft 60 (e.g. by a mating knob) which can only occur when user card 221 is in its correct position will open or unlock the lock.

Once the gate post 211 is located inside channel 230 of slide plate 206, if so desired, the user card 221 can be removed with the locking mechanism in the secured unlocked position.

Figure 6:
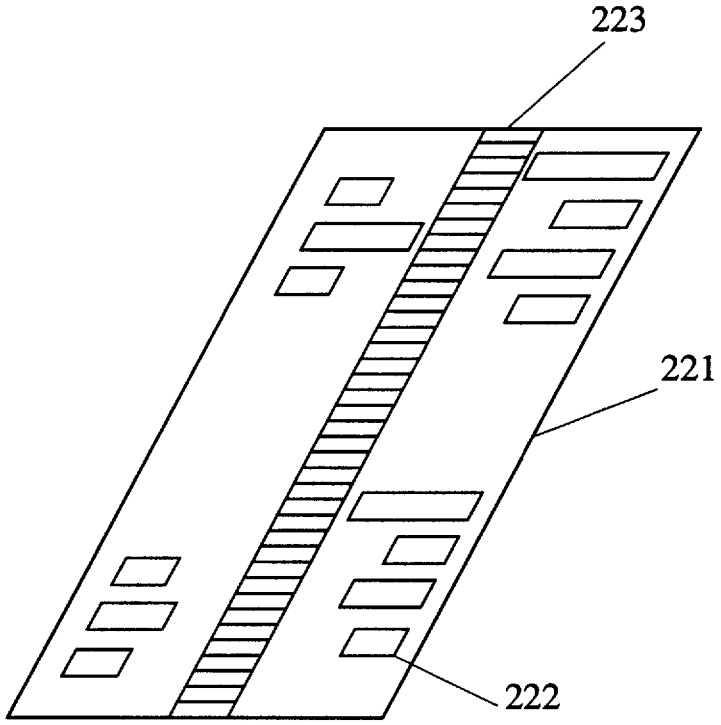
FIG. 6 shows one embodiment of a card key according to the present invention.

The user card 221 as illustrated in FIG. 6 preferably also contains a magnetic strip 223 for use in those situations where other information may be required, or possibly other locking mechanisms can be associated with the mechanical locking mechanism of the present invention. The arrangement of holes 222 allows the presence of a magnetic strip 223 without diminishing the possible number of combinations.

Possible variations include the provision of latching means to generally operate the lock, and deadlocking means to make the bolt plate 210 go through a double length movement in order to ensure deadlocking of the lock.

Combinations of these locks whilst not being variable can be changed by changing the combination of slide plates 206. The locking mechanism has preferably 7 or 8 slide plates 206. The locking mechanism can operate with any number of slide plates 206, however, a lower number will result in a decrease in the number of combinations which are possible and thus a reduction in security level.

One of the advantages of the present invention is that the card is not worn and the lock mechanism is not worn by the action of inserting the card. Wearing occurs only when the cam shaft 60 is turned, and this does not transfer any force to the card.

Third Embodiment

This embodiment of the invention allows for use of the stepped plate arrangement, together with a simple re-keying procedure using a combination card.

Figure 9:
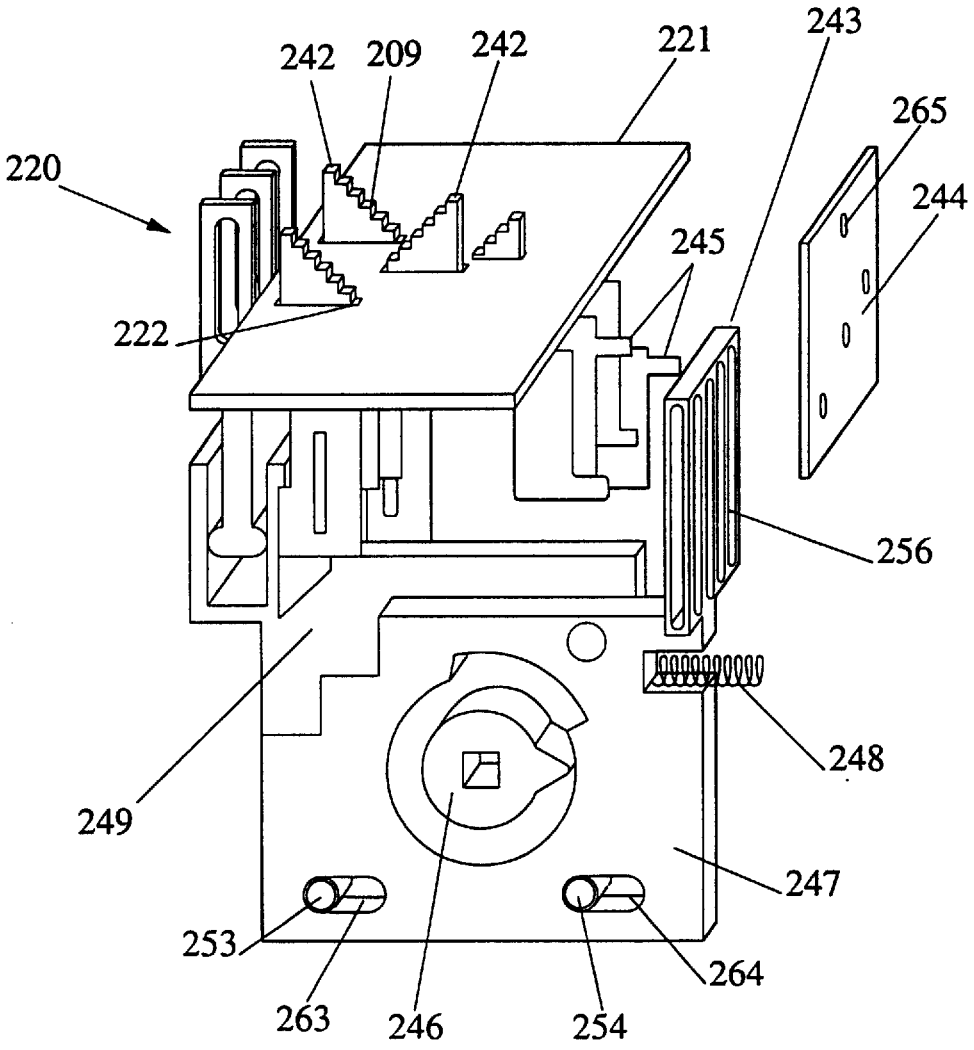
FIG. 9 is a cut away perspective view of a third embodiment of the present invention.

Referring to FIG. 9, there is shown generally a lock 220 including a setting or combination card carriage 247 supported via pins 253 and 254 received in recesses 263, 264. Cam means 246 is defined in carriage 247.

Combination card receiving means 243 is arranged on carriage 247, and is adapted to receive combination card 244.

Plate assembly 249 comprises a number of slide plates 242 having a predefined stepwise configuration 209 on or in an upper surface thereof, as has been described in relation to the second embodiment. However, according to this embodiment each slide plate 242 also includes, remote from the stepwise configured upper surface, a tab or lug 245 engageable in a corresponding slot 256 in combination card receiving means 243.

Combination card 244 includes a number of slots or holes 265 of predetermined configuration to match the configuration of the number of lugs 245 on slide plates 242.

User card 221 as previously described includes recesses 222, which may be of any desired configuration, but are preferably square or rectangular, which when correctly positioned with respect to the step portions 209 of slide plates 242 allow the step portions to move in an upward direction until such time as a step of the step portion cannot progress any further.

Biasing means 248 in the form of a spring biases the combination card receiving means 243 in the direction of slide plates 242 and if the combination card 244 corresponding to the user card 221 is present in the receiving means 243, the lock can be opened.

Figure 10:
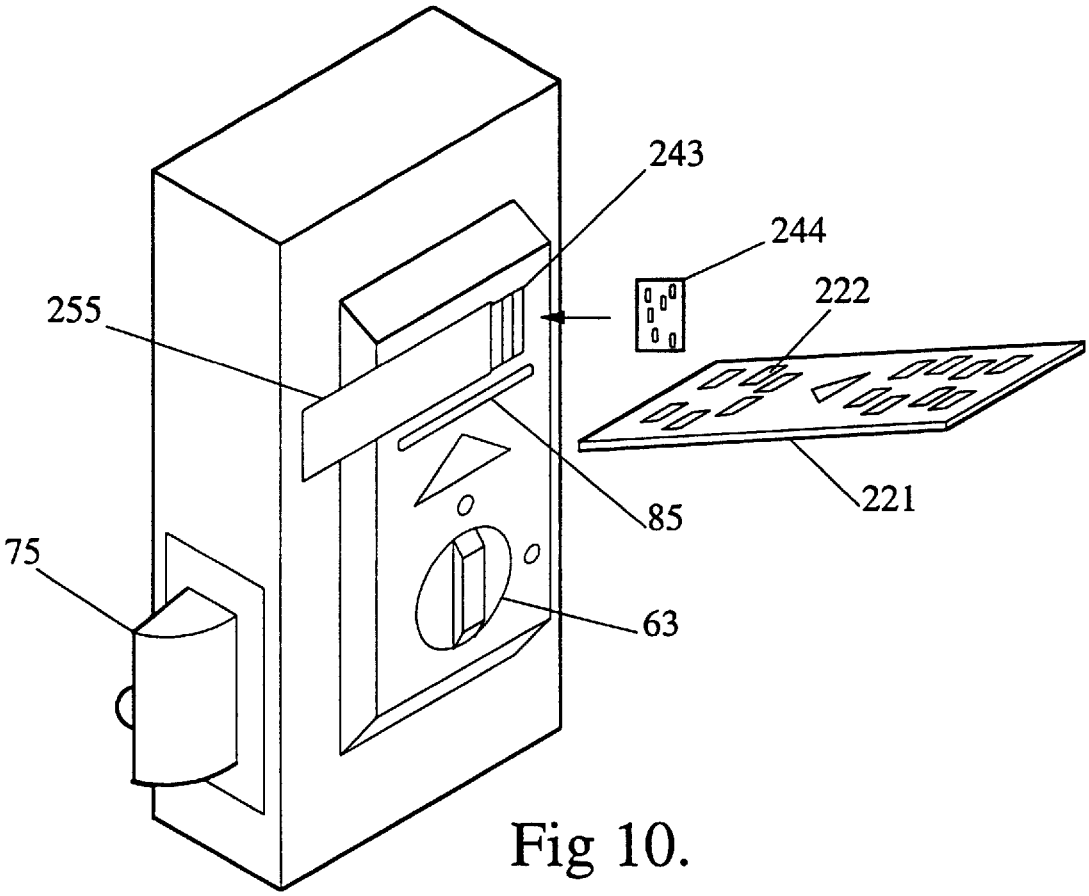
FIG. 10 shows a perspective view of the assembled lock according to the third embodiment.

FIG. 10 provides a depiction of a preferred external lock configuratlon, similar to FIG. 4. Shutter 255 is slidable with respect to tihe body of lock 220, and provides added security in that it acts as a barrier to improper insertion of a combination card 244. The shutter 255 is operable and openable by user card 221 to allow ingress of a combination card 244 into receiving means 243 only if the correct user card 221 is inserted into user card slot 85. Latch mechanism 75 may be of any suitable type.

The operation of the interlocking mechanism can be described as follows.

User card 221 is inserted into slot 85 and the cam means 246 is rotated by knob 63, preferably in an anti-clockwise direction. The step portions 209 of slide plates 242 pass upwardly through the recesses 222 in user card 221, causing the slide plates 242 to re-align horizontally. The re-aligned plate assembly 249 accordingly defines a specific pattern of the lugs 245 on slide plates 242. The user card 221 thus facilitates the formation of a desired lug combination.

On matching of the correct user card/slide plate combination, shutter 255 slides open, allowing the insertion of combination card 244 into care receiving means 243. The combination card 244 has a predefined punched pattern therein, which is configured to align with the combination formed by the lugs 246 as the cam means 246 is rotated further.

Spring 248 biases the card receiving means 243 towards the lugs 245 if the correct combination card 244 is inserted into the receiver 243. On matching, the lugs 245 will pass through the card 244, allowing the cam means 246 to continue to rotate and to thereby facilitate unlocking of the lock.

It will be realised that if re-keying of the lock is for some reason required or desired, it is a simple matter of changing the combination card 244 so as to correspond to a new user card 221 combination.

Fourth Embodiment

A further example of a lock utilising the principles of the present invention will be described with reference to FIG. 11. This example is a further preferred mode of implementing the invention.

Figure 11:
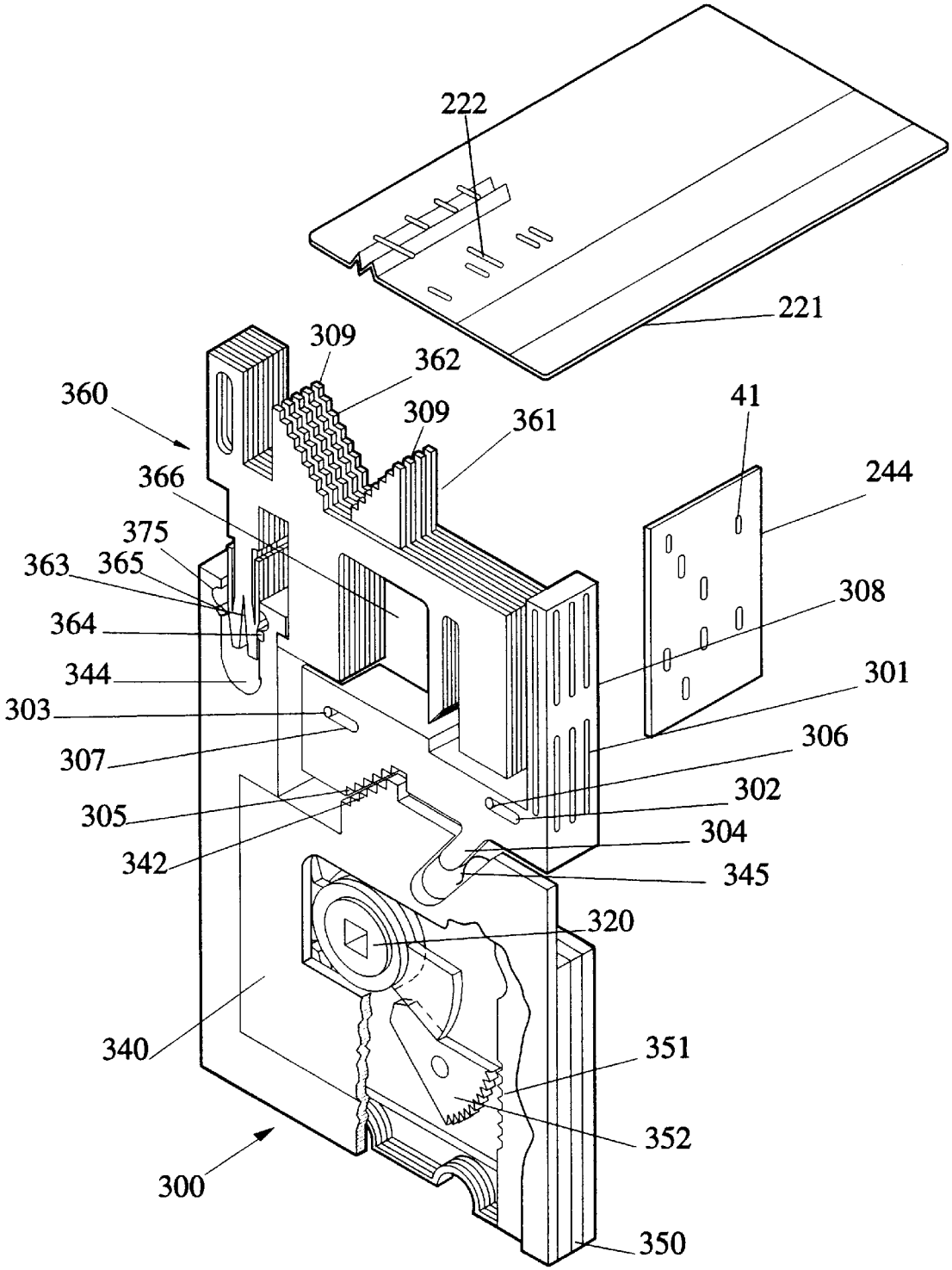
FIG. 11 is a cut away perspective view of a fourth embodiment of the present invention.

FIG. 11 shows a generally similar embodiment to FIG. 9. utilising user cards 221 and combination cards 244 of similar type.

The slide plate assembly 360 comprises alternating left 362 and right 361 slide plates with upper stepped projections 309. The front slide plate 369 and rear plate 368 are slightly different in their construction from the other plates as will be discussed below (see FIG. 15).

The combination assembly 301 comprises a carrier 308 for receiving combination card 244, recesses 306, 307 receiving corresponding pins 302, 303, teeth 305 and projection 304. Pins 302, 303 are part of the body, which is not shown so as to enhance clarity.

Main plate assembly 350 is arranged so as to travel up and down relative to the combination assembly 301 and slide plate assembly 360, and includes cam device 320. Lock plate 340 lies parallel to plate assembly 350, and includes teeth 342 corresponding to teeth 305.

Figure 16:
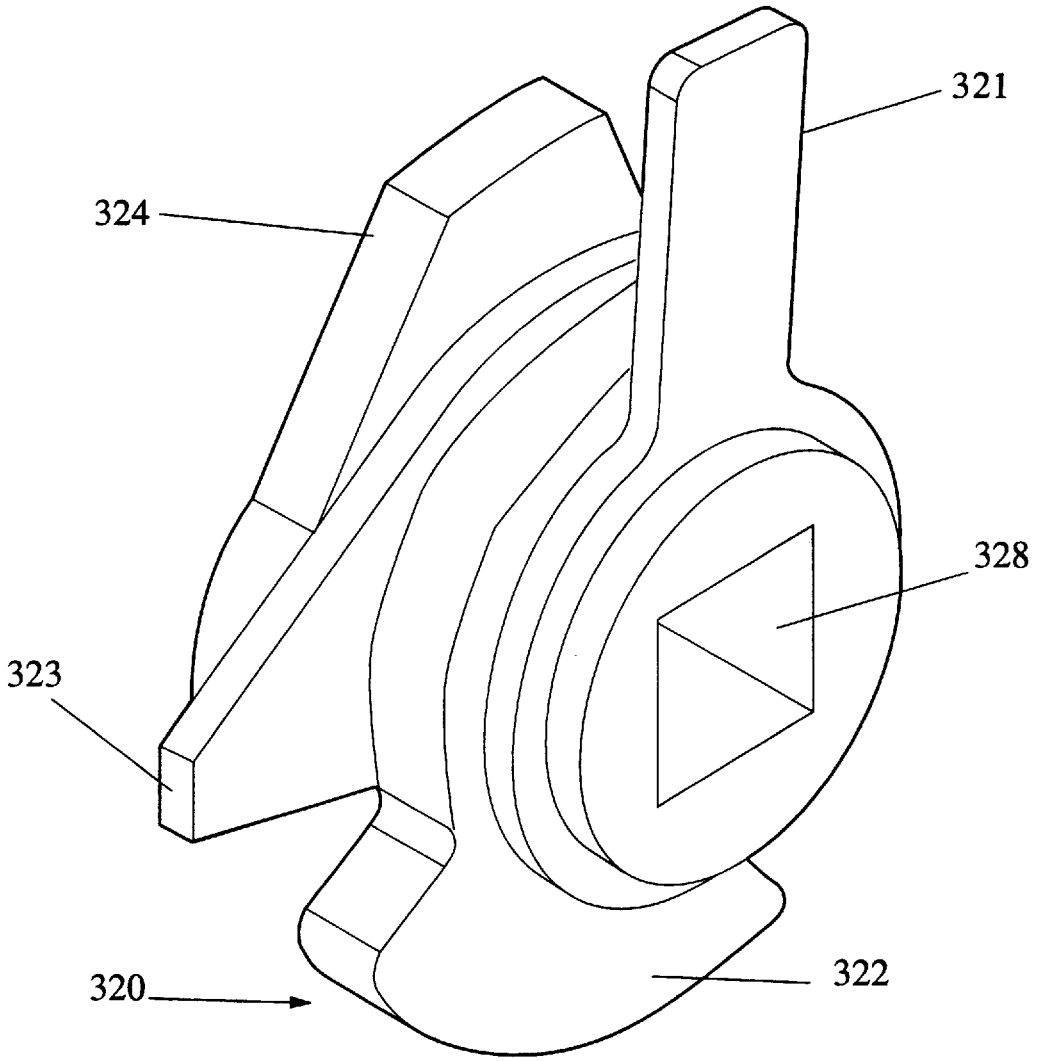
FIG. 16 illustrates the cam arrangement according to the fourth embodiment.

Cam device 320 (see FIG. 16) includes a channel 328 for receiving a handle, cams 322 and 324 for raising and lowering respectively plate assembly 350, and cams 323 and 321 for raising and lowering respectively the lock plate assembly.

It will be understood that for correct operation to occur, combination card 244 and user card 221 are correctly inserted into their respective positions, and that they must be a corresponding pair.

In use, rotating cam device 320 initially causes cam 322 to engage tans 352 (the left side is not visible) which engage teeth 351 and start to lift main plate assembly 350. This starts to lift slide plate assembly 360 via compressible fingers 363 on each slide plate, and rollers 364. It will be understood that (after some travel) step portions 309 of slide plates 361, 362 enter the slots of user card 221 as far as possible, and that each slide plate then ceases further upward motion. This causes lugs 367 on the (as drawn) right sides on the slide plates 361, 362 to form a specific pattern.

At the same time, cam 323 engages the lock plate 340 and moves it up and to the left. This also moves, via spring 345, the combination assembly 301.

It can therefore be seen that the combination assembly 301 is moving left and up at the same time as the slide plates 361, 362 are engaging user card 221 and forming a pattern of lugs 367. If the pattern of lugs 367 matches the pattern of slots 41 in the combination card, both parts continue their relative travel, the lugs 367 enter the slots 41 in the combination card, and the lock completes its movement to the unlocked position.

If, however, any one of the lugs 367 is in the incorrect position, the travel of the combination assembly 301 is blocked, spring 345 compresses, and teeth 305 and 342 engage so as to halt travel. It is emphasised that very little force is sufficient to cause this engagement, so that little or no wear of the combination card 244 occurs.

Moreover, there is very little force transferred to the user card 221—merely the weak upward movement of the slide plates 361, 362.

Preferably, the slide plates 361, 362 and as much as possible of the rest of the mechanism are formed from a relatively rigid plastics material such as perspex. The cam device 320, and lock-operative parts of the lock plate 340 and combination assembly 301 are preferably formed from a metal alloy so as to provide break resistance.

Preferably, means are provided with the knob (not shown) for turning cam device 320 such that excessive force results in slippage of the knob, rather than damage to the mechanism.

The fan 352 and tooth 351 lifting arrangement provides for a smooth action when the knob is rotated.

When the knob is released and returned to the initial position, cam 321 returns the lock plate through engagement with a suitable recess (not shown), and cam 323 lowers the main plate assembly 350.

The operation of the "fingers" 363 of the slide plates 361, 362 is important to functionally implementing a reliable lock.

When the fingers 363 are rising in the recess 344, rollers 364, 365 maintain pressure on the fingers, and are forced into the upper part of recess 375 by the resilient outward force of the fingers 363. At the end of the fingers 363 travel, this force is removed and rollers 364, 365 can drop into the lower part of the recess. Extra fingers 371 on the front slide plate 369 and rear slide plate 368 ensure this occurs prior to the downward travel.

In the embodiment shown in FIG. 11, any time a correct card is engaged, the combination card can be changed. The present invention, however, lends itself readily to master keying, and many possible keys may match any given combination card particularly maid keys, and master keys (of various levels) may be employed. The more slots and options for size, the more possibilities for cards are created. Dummy slots or indentations are preferably included in the combination cards thus further increasing the difficulty of surreptitiously manipulating the lock.

In a master keyed environment, for instance a hotel, it is desirable that only authorised personnel can alter the combination key. Using an arrangement with a master Key, the lock has two open positions, only one of which allows the combination card 244 to be removed. The H-shaped opening on front slide plate 369 allows, in combination with pin in shutter 380, for such an arrangement. Normal user keys leave the pin at the top, and then bottom, of the left arm of the H. The master key leaves the pin in the middle, so that the shutter 3B0 can be slid back (see FIGS. 12, 13) and the combination card changed.

Figure 12:
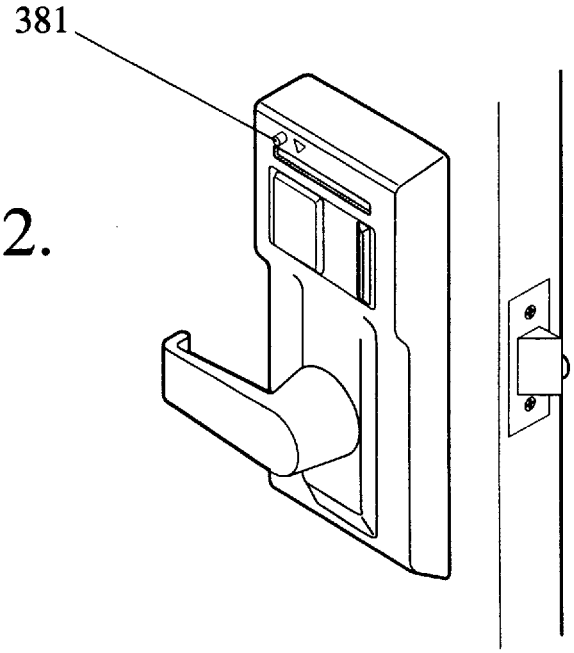
FIG. 12 is a perspective view of an assembled lock according to the forth embodiment showing the combination card shutter open.
Figure 13:
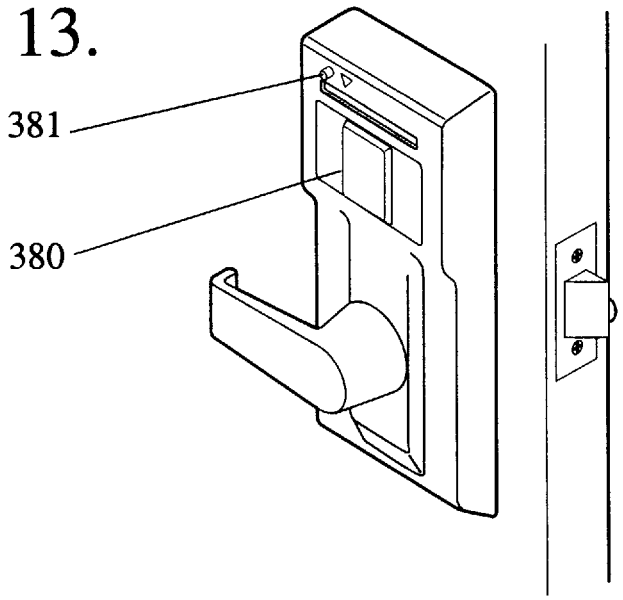
FIG. 13 is a similar view to FIG. 12 showing the shutter closed.
Figure 14:
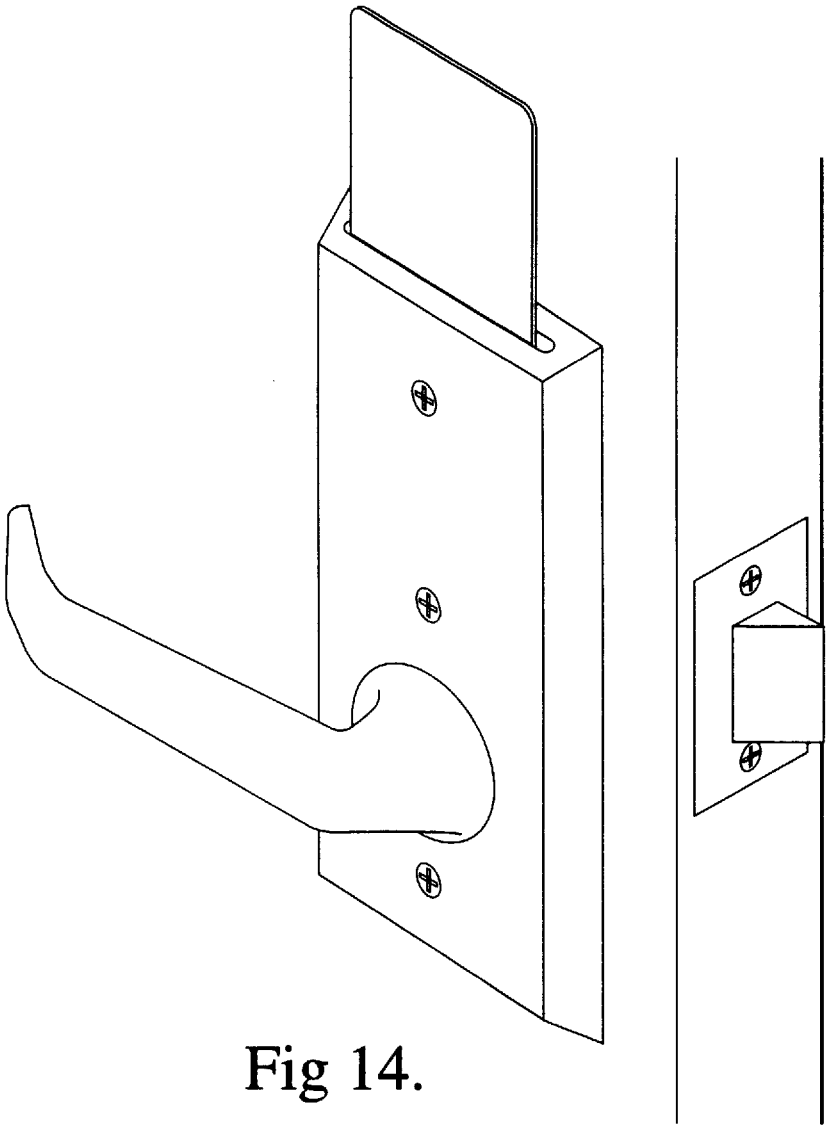
FIG. 14 shows the rear of the assembled lock according to the fourth embodiment.
Figure 15A:
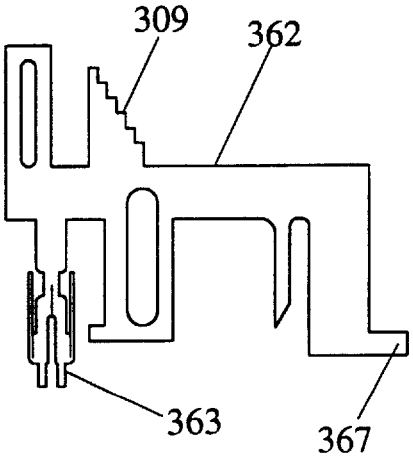
FIG. 15 illustrates the slide plates according to the fourth embodiment.
Figure 15B:
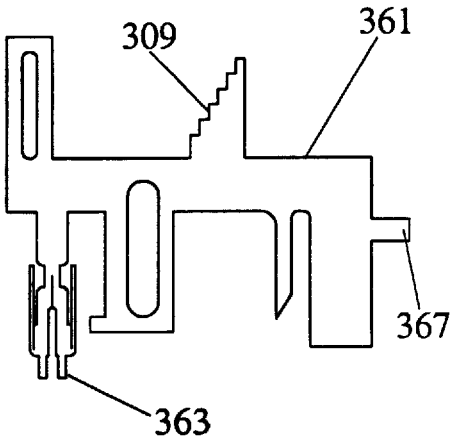
Figure 15C:
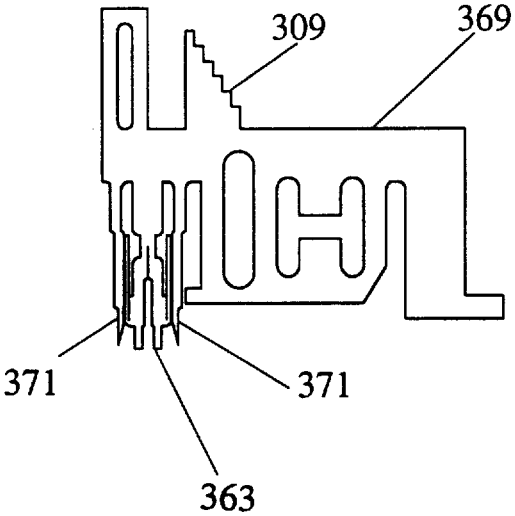
Figure 15D:
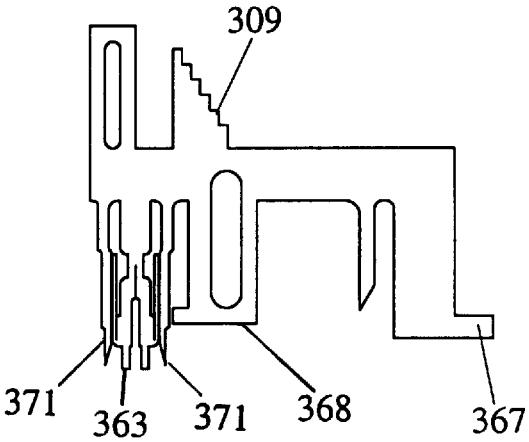

The lock, shown in FIGS. 12 and 13, also allows for a privacy feature. As shown in FIG. 14, the user card may be inserted into a slot once in the room. This engages a bevelled end of pin 381, which protrudes so as to indicate a desire for privacy. It also engages a small lug (not shown) which prevents other cards, or the maid's card, from being fully inserted. The master card may include a notch corresponding to the lug, so as to override the privacy request if necessary.

The user cards and combination cards may be formed from any suitable material, but a plastics material such as is commonly used for credit cards is preferred.

It will be appreciated that while the embodiments shown relate to one-sided key arrangements, the present invention is readily adapted to be opened from either side of the lock if desired. It will also be noted that the mechanism can be manufactured such that it can be used for either left or right hand opening doors.

Cards may be cut by any suitable means, but a computer-controlled punching system is currently preferred.

Industrial Applicability

The present invention is suitable for use particularly in commercial or industrial situations, such as hotels, offices, factories, schools and the like. It is also, however, applicable for domestic use. Whilst the embodiments described relate to door latch applications, the invention can equally be used for locks of any type, subject to modifications of size, shape. etc.

It will be appreciated that variations and additions are possible within the spirit and scope of the invention.

I claim:

1. A lock system comprising:

a combination card having a pattern of structures defining a combination;

a user card having a first surface, an opposed second surface, and a plurality of apertures extending from the first surface to the second surface defining a pattern providing a key combination corresponding to said combination; and a lock mechanism being settable for release thereof by said pattern of structures, comprising a body having a first receptacle for receiving said user card, and defining a first plane within which said user card moves in a linear fashion;

a second receptacle for receiving said combination card;

a key plate assembly having a plurality of parallel stacked slide plates supported by said body for linea movement relative to each other and said body in respective second planes that extend subantially perpendicular to said first plane, said slide plates being fixed with respect to the direction of movement of said user card in said first plane and moving in said second planes in a direction substantially perpendicular to said first plane, at least some of said slide plates having a projecting member adapted for insertion into said apertures of said user card;

release setting means for setting the lock mechanism into a state enabling its release with said user card, said release setting means arranged in displaceable manner and having engagement members for engagement witt said pattern of structures of said combination card received in said second receptacle;

operating means for sliding said key plate assembly towards said user card received in said first receptacle such that individual ones of said slide plates are moved into a realigned state by insertion of said projecting members of said slide plates into corresponding ones of said apertures of said user card into a configuration dictated by said key combination, said release setting means cooperating with said key plate assembly to release said lock mechanism only when said slide plates are moved into their said realigned state by said operating means and said engagement members are moved into correct engagement with said pattern of structures of said combination card; wherein said second receptacle extends in a plane that is substantially perpendicular to said first plane of said first receptacle, said lock mechanism further comprising a combination card carriage having said second receptacle, said combination card carriage being supported by said body for movement towards and away from said key plate assembly.

2. A lock system according to claim 1, wherein said lock mechanism further comprises biasing means for biasing said combination card carriage towards said key plate assembly.

3. A lock system according to claim 1, wherein said release setting means comprises at least some of said plurality of slide plates, said engagement members comprise a set of lugs extending from said at least some of said plurality of slide plates, said pattern of structures comprise a plurality of openings in said combination card, and said lugs having a shape such as to be matchingly receivable in said openings in said combination card.

4. A lock system according to claim 3, wherein a plurality of said openings in said combination card have a predetermined configuration to match a plurality of said lugs on said slide plates having a similar configuration.

5. A lock system according to claim 3, wherein said projecting members are provided on first edges of said slide plates and said lugs are provided on second edges of said slide plates.

6. A lock system according to claim 4, wherein said combination card further comprises means including a plurality of dummy openings for increasing the difficulty of surreptitious manipulation of said lock mechanism.

7. A lock system according to claim 1, wherein said projecting members of said slide plates include a stepped portion, said openings in said user card being rectangular in shape such that when said user card is inserted in said first receptacle and said key plate assembly is slid towards said user card, said realigned state of said slide plates is defined by the respective depth of insertion which each rectangular shaped opening permits a respective one of said projecting members of said slide plates received therein to achieve.

8. A lock system according to claim 7, wherein said projecting members are provided on one edge of said slide plates at different positions along said one edge.

9. A lock system according to claim 8, wherein said slide plates are alternately stacked in the key plate assembly such that alternate slide plates have projecting members provided towards opposite ends of the key plate assembly.

10. A lock system according to claim 1, wherein said lock mechanism further comprises a main plate assembly adapted for relative movement with respect to said key plate assembly and coupling means for moving said slide plates towards said user card and allowing individual slide plates to cease moving upon the respective projecting member of any one said slide plate being fully received in a corresponding one of said user card apertures, thereby preventing further motion of said slide plates, said coupling means being disposed between said main plate assembly and said slide plate assembly.

11. A lock system according to claim 10, wherein said coupling means comprise a set of resiliently compressible fingers, each compressible finger protruding from one edge of one of said slide plates, and a recess in a portion of said main plate assembly facing said compressible fingers, said compressible fingers disposed for reciprocating movement within said recess to permit differential relative movement between said individual slide plates and said main plate assembly.

12. A lock system according to claim 10, wherein said lock mechanism further comprises a lock plate disposed in a plane parallel to a plane of said main plate assembly for sliding movement relative thereto, said lock plate being engaged by said operating means and preventing release of said lock mechanism when a key combination of a user card inserted into said first receptacle does not correspond to a combination of a combination card inserted into said second receptacle and the operating means are actuated.

13. A lock system according to claim 12, wherein said operating means includes a cam device operatively engageable with said main plate assembly and said lock plate for controlling movement thereof, said cam device being rotatably operable by a user actuated handle.

14. A lock system according to claim 13, wherein said lock mechanism further includes mechanical buffering means for buffering said cam device from said user actuated handle to prevent excessive force being transmitted from said handle via said main plate assembly and said slide plates to said user card.

15. A lock system according to claim 1, wherein said lock mechanism further comprises shutter means located proximate said second receptacle and movable between an open and a closed state, said shutter means moving from said closed state, in which removal of said combination card from said second receptacle is prevented, to said open state only when said slide plates are in their said realigned state wherein the key combination corresponds to the combination of said combination card.

16. A lock system according to claim 1, further including at least one second combination card having a pattern of structures defining a second combination for setting said lock mechanism to enable release thereof, at least one second user card having a first surface, an opposed second surface, and a plurality of apertures extending from the first surface to the second surface and arranged in a pattern defining a second key combination corresponding to said second combination, and at least one master card having a first surface, an opposed second surface, and a plurality of apertures extending from the first surface to the second surface and arranged in a pattern providing a master combination for releasing said lock mechanism, said master combination being compatible with said first combination and said second combination wherein said master card releases said lock mechanism when one of said first combination card and said second combination card is inserted in said lock mechanism.

17. A lock system according to claim 16, wherein said lock mechanism further comprises a shutter located proximate said second receptacle and movable between an open and a closed state, said closed state preventing removal of a combination card from said second receptacle, said lock mechanism having two settings, a first setting in which said lock mechanism is releasable using a user card and said shutter is in said closed state, and a second setting in which said shutter is movable into said open state and said lock mechanism is releasable using only said master card, at least one slide plate being in a realigned state only when said master card is inserted in said lock mechanism, said second setting being achieved when said at least one slide plate is in its realigned state during actuation of the operating means.

18. A lock system according to claim 1, wherein said release setting means comprises a lock plate assembly having a plurality of parallel stacked lock plates supported by said body for linear movement relative to each other in respective third planes that extend substantially perpendicular to said first plane, said engagement members being formed at edges of at least some of said lock plates, said pattern of structures comprising a plurality of slots formed in an edge of said combination card, said plurality of slots being shaped to matchingly receive said engagement members of said lock plates, and said second receptacle is arranged such that said combination card is engageable via said plurality of slots with said lock plates to realign said lock plates into a pattern conforming with said plurality of slots.

19. A lock system according to claim 18, wherein said lock plate assembly is coplanar with said key plate assembly, at least some of said lock plates having a recess formed in an edge facing said key plate assembly and a corresponding number of said slide plates having a tab protruding from an edge thereof towards said recesses, said recesses in said lock plates receiving said tabs, said tabbed slide plates moveable towards said recessed lock plates and in a direction perpendicular thereto, said slide plates, said projecting members, said tabs, said lock plates, said recesses and said first receptacle being arranged such that the key plate assembly is movable from an initial position, in which the lock mechanism is locked, towards said user card into a second position, in which said projecting members are inserted into said acres in said user card thereby having realigned said slide plates in said perpendicular direction in accordance with said key combination, said tabs having attained a corresponding pattern, and finally to a third position, in which said lock mechanism is released, said third position attainable only when said tab pattern corresponds with the pattern which said slotted edge of said combination card imparts on said recesses of said lock plates thereby permitting engagement of respective tabs within respective recesses.

20. A lock system according to claim 18, wherein said lock mechanism further comprises spring means for returning said slide plates and said lock plates from a state in which said slide plates and said lock plates have attained their realigned state in conformity with said key combination and said plurality of slots, respectively, to a state where said slide plates and said lock plates are not in said realigned state.

21. A lock system according to claim 18, wherein said combination card further comprises means including a plurality of dummy slots for increasing the difficulty of surreptitious manipulation of said lock mechanism.

22. A lock system according to claim 1, wherein said openings in said user card are arranged in two pattern groups at opposite ends of said user card, said two pattern groups being mirror images of one another.

23. A lock system according to claim 1, wherein said user card has magnetic stripe means for operating a magnetic card reader associated with other components of said lock mechanism.

24. A lock system according to claim 1, wherein said user card is of substantially planifoim configuration, said apertures having a substantially rectangular shape, a long axis of said rectangular shaped apertures being generally perpendicular to a direction of insertion of said user card into said first receptacle, said projecting members of said slide plates being insertable to a depth which is dependent on the length of said rectangular apertures along said long axis, said rectangular apertures defining the extent of realignment of said slide plates for releasing said lock mechanism.

25. A lock system comprising:

a combination card having a pattern of structures defining a combination;

a user card having a fit surface, an opposed second surface, and a plurality of apertures extending from the first surface to the second surface defining a pattern providing a key combination corresponding to said combination; and a lock mechanism being settable for release thereof by said pattern of structures, comprising a body having a first receptacle for receiving said user card, and defining a first plane within which said user card moves in a linear fashion;

a second receptacle for receiving said combination card;

a key plate assembly having a plurality of parallel stacked slide plates supportd by said body for linear movement relative to each other and said body in respective second planes that extend substantially perpendicular to said first plane, said slide plates being fixed with respect to the direction of movement of said user card in said first plane and moving in said second planes in a direction substantially perpendicular to said first plane, at least some of said slide plates having a projecting member adapted for insertion into said apertures of said user card;

release setting means for setting the lock mechanism into a state enabling its release with said user card, said release setting means arranged in displaceable manner and having engagement members for engagement with said pattern of structures of said combination card received in said second receptacle; and operating means for sliding said key plate assembly towards said user card received in said first receptacle such that individual ones of said slide plates are moved into a realigned state by insertion of said projecting members of said slide plates into corresponding ones of said apertures of said user card into a configuration dictated by said key combination, said release setting means cooperating with said key plate assembly to release said lock mechanism only when said slide plates are moved into their said realigned state by said operating means and said engagement members are moved into correct engagement with said pattern of structures of said combination card, said operating means including a cam device operatively engageable with said main plate assembly and said lock plate for controlling movement thereof, said cam device being rotatably operable by a user actuated handle;

a main plate assembly adapted for relative movement with respect to said key plate assembly and coupling means for moving said slide plates towards said user card and allowing individual slide plates to cease moving upon the respective projecting menber of any one said slide plate being fully received in a correspoding one of said user card apertures, thereby preventing further motion of said slide plates, said coupling means being disposed between said main plate assembly and said slide plate assembly; and a lock plate disposed in a plane parallel to a plane of said main plate assembly for sliding movement relative thereto, said lock plate being engaged by said operating means and preventing release of said lock mechanism when a key combination of a user card inserted into said first receptacle does not correspond to a combination of a combination card inserted into said second receptacle and the operating means are actuated;

wherein said second receptacle extends in a plane that is substantially perpendicular to said first plane of said first receptacle, said lock mechanism further comprising a combination card carriage having said second receptacle, said combination card carriage being supported by said body for movement towards and away from said key plate assembly and being engaged by said lock plate by releasable coupling means which couple said lock plate to said combination card carriage, and wherein movement blocking means are provided for stopping movement of said lock plate when said engagement members fail to correctly engage with said pattern of structures of said combination card received in said combination card carriage.

26. A lock system according to claim 25, wherein said releasable coupling means comprises a spring element disposed between said lock plate and said combination card carriage, said movement blocking means comprises corresponding teeth located in facing relationship on said lock plate and said combination card carriage, respectively, said corresponding teeth achieving meshing engagement upon compression of said spring element.

27. A lock system according to claim 25, wherein said pattern of structures of said combination card comprises a plurality of apertures having a predetermined configuration to match a plurality of said lugs on said slide plates having a similar configuration;

said projecting members are provided on first edges of said slide plates and said lugs are provided on second edges of said slide plates;

said projecting members of said slide plates include a stepped potion, said apertures in said user card being rectangular in shape such that when said user card is inserted in said first receptacle and said key plate assembly is slid towards said user card, said realigned state of said slide plates is defined by the respective depth of insertion which each rectangular shaped aperture permits a respective one of said projecting members of said slide plates received therein to achieve;

said lock mechanism further comprises a main plate assembly having relative movement with respect to said key plate assembly, coupling means disposed between said main plate assembly and said slide plate assembly for moving said slide plates towards said user card and allowing individual slide plates to cease moving upon the respective projecting member of any one said slide plate being fully received in a corresponding one of said user card apertures, thereby preventing further motion of said slide plates and a lock plate disposed in a plane parallel to a plane of said main plate assembly for sliding movement relative thereto, said lock plate being engaged by said operating means and preventing release of said lock mechanism when a key combination of a user card inserted into said first receptacle does not correspond to a combination of a combination card inserted into said second receptacle and the operating means are actuated; and said lugs are located on edges of said slide plates that extend perpendicular to the edges having said projecting members, said cam device, said main plate assembly, said key plate assembly and said lock plate are arranged such that fall rotation of said cam device from a first position in which said lock mechanism is locked, into a second position, in which the lock mechanism is released, is only enabled when said slide plates are moved into their said realigned state in which said projecting members of said slide plates are received in respective ones of said rectangular shaped apertures in said user card in accordance with said key combination defining a pattern of lugs which corresponds to said combination and enables correct insertion of respective lugs in respective apertures of said combination card.

28. A lock system comprising:

a combination card having a pattern of structures defining a combination;

a user card having a first surface, an opposed second surface, and a plurality of apertures extending from the first surface to the second surface defining a pattern providing a key combination corresponding to said combination; and a lock mechanism being settable for release thereof by said pattern of structures, comprising a body having a first receptacle for receiving said user card, and defining first plane within which said user card moves in a linear fashion;

a second receptacle for receiving said combination card;

a key plate assembly having a plurality of parallel stacked slide plates supported by said body for linear movement relative to each other and said body in respetive second planes that extend substantially perpendicular to said first plane, said slide plates being fixed with respect to the direction of movement of said user card in said first plane and moving in said second planes in a direction substantially perpendicular to said first plane, at least some of said slide plates having a projecting member adapted for insertion into said apertures of said user card;

release setting means for setting the lock mechanism into a state enabling its release with said user card, said release setting means arranged in displaceable manner and having engagement members for engagement with said pattern of structures of said combination card received in said second receptacle;

operating means for sliding said key plate assembly towards said user card received in said first receptacle such that individual ones of said slide plates are moved into a realigned state by insertion of said projecting members of said slide plates into corresponding ones of said apertures of said user card into a configuration dictated by said key combination, said release setting means cooperating with said key plate assembly to release said lock mechanism only when said slide plates are moved into their said realigned state by said operating means and said engagement members are moved into correct engagement with said pattern of structures of said combination card; and at least one second combination card having a pattern of structures defining a second combination for setting said lock mechanism to enable release thereof, at least one second user card having a first surface, an opposed second surface, and a plurality of apertures extending from the first surface to the second surface and arranged in a pattern defining a second key combination corresponding to said second combination, and at least one master card having a first surface, an opposed second surface, and a plurality of apertures extending from the first surface to the second surface and arranged in a pattern providing a master combination for releasing said lock mechanism, said master combination being compatible with said first combination and said second combination wherein said master card releases said lock mechanism when one of said first combination card and said second combination card is inserted in said lock mechanism;

said lock mechanism further comprising shutter located proximate said second receptacle and movable between an open and a closed state, said closed state preverting removal of a combination card from said second receptacle, said lock mechanism having two settings, a first setting in which said lock mechanism is releasable using a user card and said shutter is in said closed state, and a second setting in which said shutter is movable into said open state and said lock mechanism is releasable using only said master card, at least one slide plate being in a realigned state only when said master card is inserted in said lock mechanism, said second setting being achieved when said at least one slide plate is in its realigned state during actuation of the operatin means;

wherein said at least one slide plate has an H-shaped opening arranged to receive a pin of said shutter, said user card leaving said pin at one of the top and bottom of one of the parallel legs of said H-shaped opening, said master card leaving said pin in a position in which said pin may be slid into the perpendicular leg of said H-shaped opening.

* * * * *

UNITED STATES PATENT AND TRADEMARK OFFICE

CERTIFICATE OF CORRECTION

PATENT NO. : 5,884,511

DATED : March 23, 1999

INVENTOR(S) : Preddey

It is certified that error appears in the above-indentified patent and that said Letters Patent is hereby corrected as shown below:

Column 4, line 32-33, delete "(not shown)".

Column 7, line 5, replace "horizontally" with --vertically--.

Column 8, line 47, "upper part of recess 375" with --upper part 375 of recess 344--.

Signed and Sealed this

Twenty-eighth Day of September, 1999

*Attest:*

Q. TODD DICKINSON

*Attesting Officer*

*Acting Commissioner of Patents and Trademarks*